United States Patent [19]

Lalande et al.

[11] Patent Number: 5,054,555

[45] Date of Patent: Oct. 8, 1991

[54] TENSION-ACTUATED MECHANICAL DETONATING DEVICE USEFUL FOR DETONATING DOWNHOLE EXPLOSIVE

[75] Inventors: Phillip T. Lalande; W. Keith Acker, both of Lafayette, La.

[73] Assignee: Technical Concepts, Inc., Lafayette, La.

[21] Appl. No.: 616,905

[22] Filed: Nov. 21, 1990

[51] Int. Cl.[5] ..... E21B 43/116

[52] U.S. Cl. ..... 166/298; 166/55.1

[58] Field of Search ..... 166/297–299, 166/55, 55.1, 55.2

[56] References Cited

U.S. PATENT DOCUMENTS

| | | | |
|---|---|---|---|
| 1,853,239 | 4/1932 | Shull . | |
| 2,766,828 | 10/1956 | Rachford, Jr. | 166/36 |
| 2,934,146 | 4/1960 | Laval, Jr. | 166/55 |
| 3,409,081 | 11/1968 | Brown | 166/35 |
| 3,706,340 | 12/1972 | Schuster | 166/297 |
| 3,990,507 | 11/1976 | Vann | 166/55.1 |
| 4,375,834 | 3/1983 | Trott | 166/55.1 |
| 4,690,218 | 9/1987 | Sumner | 166/297 |
| 4,830,120 | 5/1989 | Stout | 166/298 X |

OTHER PUBLICATIONS

Otis Engineering Corporation (A Halliburton Company) Publication–Shows and Discusses a Pressure and Acceleration–Sensitive, Battery–Powered Triggering Device.

Otis Engineering Corporation (A Halliburton Company) Publication Discusses Otis Subsurface Flow Control Completion Equipment and Discusses Commerically Available Landing Nipple/Lock Mandrel Arrangements.

Slick Line, Mechanically Actuated, Twin Jet Perforator Publication Shows and Discusses the Mechanical Jar–Actuated Perforator.

*Primary Examiner*—Thuy M. Bui

*Attorney, Agent, or Firm*—Cushman, Darby & Cushman

[57] ABSTRACT

The tool is a mechanically operated detonating device that is actuated by tension. The device is run into a hole on a slick line or tubing and latched. When a predetermined upward pull is provided on the supporting line, a firing pin is released and fires an initiator. Typical uses are perforating, cutting and setting plugs in casing, tubing and drill pipe. Additional tension thereafter applied can be used for recovering the tool or a major portion thereof from the hole, on the supporting line.

9 Claims, 6 Drawing Sheets

TENSION-ACTUATED MECHANICAL DETONATING DEVICE USEFUL FOR DETONATING DOWNHOLE EXPLOSIVE

BACKGROUND OF THE INVENTION

Subterranean cavities are drilled in formations for many purposes, e.g., for extracting oil, gas, geothermal steam, water, elemental sulfur, or other valuable chemicals, for establishing research and testing bore holes, for gaining access to sites for underground storage of petroleum, and for facilitating pressurization and depressurization of subterranean formations for water flooding, and the like.

In the course of drilling and completing such wells and other holes (generically "holes"), it is often advantageous to be able to conduct a step or a process which requires the focused, localized application of a substantial amount of energy within a short time, such as by firing an explosive charge in order to move a concentrated mass in a desired direction. Typical uses, in this context, are perforating or cutting a tube, pipe or similar element, or setting a packer or plug.

In actual practice, most devices of this type in current use are electrically activated. This fact means that these are costs and delays associated with performing such steps, and these are particularly felt in the case of offshore drilling of petroleum wells. If an operator determines that the need to perform one of these steps exists, it usually means that a service person, with tools must be transported out to the rig, with an electrically operated detonator, made up on an electric cable, attached to a hoist device, lowered into the well and actuated by the visiting specialist. Expensive rig time is lost while these activities are carried out.

In recognition of the problems associated with electrical actuation of detonators from the surface, others working prior to the present inventor have devised triggering devices which can be run into a hole on a nonelectrical cable or tube, i.e., on a so-called slickline. In this regard, the present inventors are aware of the Otis ETD tool. This pressure-actuated triggering device includes battery-powered components. The triggering device is set to explode a set number of minutes after being exposed to a certain pressure, unless it has been moved in the interim. The present inventors believe this device to have shortcomings, in that its location may not be known and it may become somewhat like a "hot potato" if one has had second thoughts about whether it should fire, and must keep moving it to prevent its exploding.

The present inventors also are aware of a Twin Jet Perforator (manufacturer unstated), which is designed to be lowered into a well on a slick line, and fired by jarring down and thereby hammering a firing pin. The present inventors believe this device to have shortcomings, in that it is difficult or impossible to use in directional wells, and the presence of heavy mud in a well can cause such friction or buoyancy that insufficient acceleration of the tool can be produced, so that jarring and firing do not occur.

Also, a device which fires by jarring can prematurely, accidentally fire if dropped by a worker before it is run into the well and/or while running in the well.

SUMMARY OF THE INVENTION

The tool is a mechanically operated detonating device that is actuated by tension The device is run into a hole on a slick line or tubing and latched. When a predetermined upward pull is provided on the supporting line, a firing pin is released and fires an initiator. Typical uses are perforating, cutting and setting plugs in casing, tubing and drill pipe. Additional tension thereafter applied can be used for recovering the tool or a major portion thereof from the hole, on the supporting line.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

FIGS. 1–4 depict, schematically, a practice of the invention, for perforating a tubing string (In general, no technical distinction is made in this document between tubing, casing, pipe, and other oil/gas/water/chemical tubular goods. Thus, casing tubing, pipe, or the like, when used, can be considered to be generic and interchangeable, unless contrary information is evident from the context.) Much structure that would actually be present at the site depicted in FIGS. 1–4 has been omitted, in order to avoid obscuring the features which are shown. In general, the context of FIGS. 1–4 is a well or other hole, drilled as a bore hole into rock from the surface, which may be on land, or under a body of water. The hole is conventionally drilled and completed to the stage depicted in FIG. 1. At this stage, the hole has suspended in it (and, typically, cemented in place and/or hung from a well-head (not shown) or supported from a platform, in the instance of drill pipe) a string of tubing 10.

At a desired location down hole, a completion nipple, i.e., a landing nipple 12 has been run, landed and locked in place. In essence, this device provides the tubing string, at a desired level, with an internal circumferential seat 14. If the desired location of the landing nipple 12 is known in advance, it can be incorporated in the tubing string as the tubing string is made up and run into the well. Otherwise, it may be run and set after the tubing string has been run. A suitable landing nipple is made by Otis Engineering and sold under the name Otis No-Go nipples, for use with Otis lock mandrels. The tubing string 10 is, for instance, a string of 2 $\frac{7}{8}$ inch petroleum well completion tubing.

Figure 1:
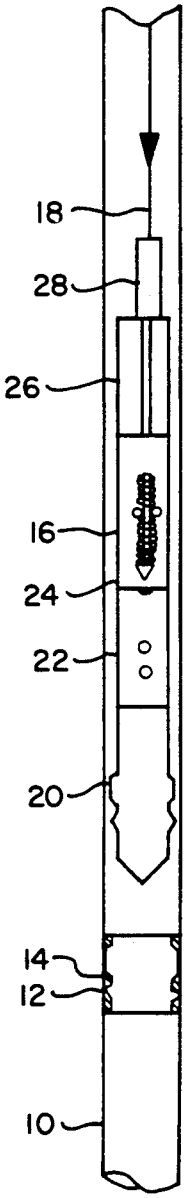
FIGS. 1–4 are schematic longitudinal sectional views of a petroleum well, showing successive stages of running, setting, firing and recovering a tool constructed in accordance with principles of the invention, for perforating a tubing.

At the stage depicted in FIG. 1, a tool 16 embodying principles of the present invention has been made up, suspended from a slick line, i.e., a conventional wireline 18, and run into the well. As shown, it has almost reached the level where the seat 14 of the landing nipple 12 is provided.

The tool 16 is seen to include a series of elements including (beginning from the bottom), a locking mandrel 20 (such as the conventional Otis lock mandrel referred to above), a perforator gun 22, a firing head 24, wireline jar 26, and a wireline rope socket 28 secured on a lower end of the wireline 18.

Figure 2:
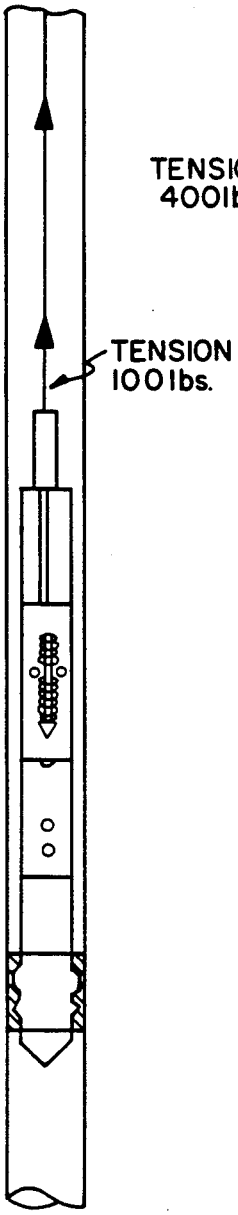

At the subsequent stage depicted in FIG. 2, the locking mandrel has landed and locked in the seat 14 of the landing nipple 12. At this stage, a first, relatively low level of tension pulled upwards on the wireline 18 from above (e.g., 100 pounds of pull) provides confirmation that the tool is locked in place at the intended downhole level.

Figure 3:
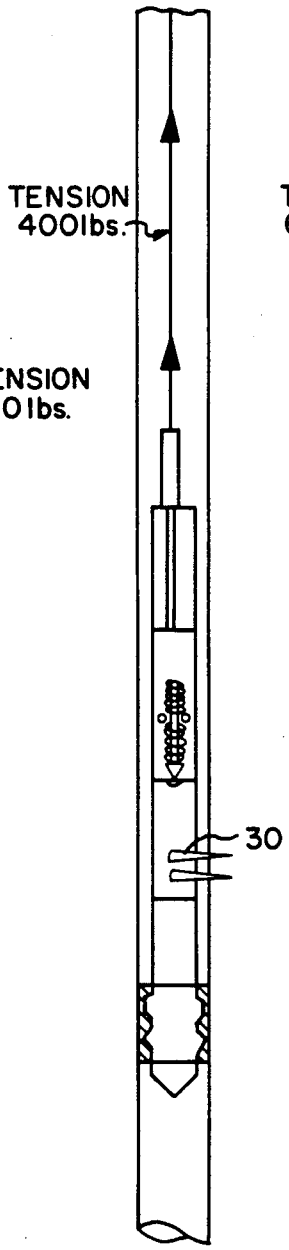

At the subsequent stage depicted in FIG. 3, as a result of a further, intermediate level of tension pulled upwards on the wireline 18 from above (e.g., 400 pounds of pull), the firing head 24 has fired, actuating the perforator gun 22, which has fired shot 30 through the sidewall of the tubing 10 at a predetermined level above the seat 14, causing perforations 32 in the tubing at that level.

Figure 4:
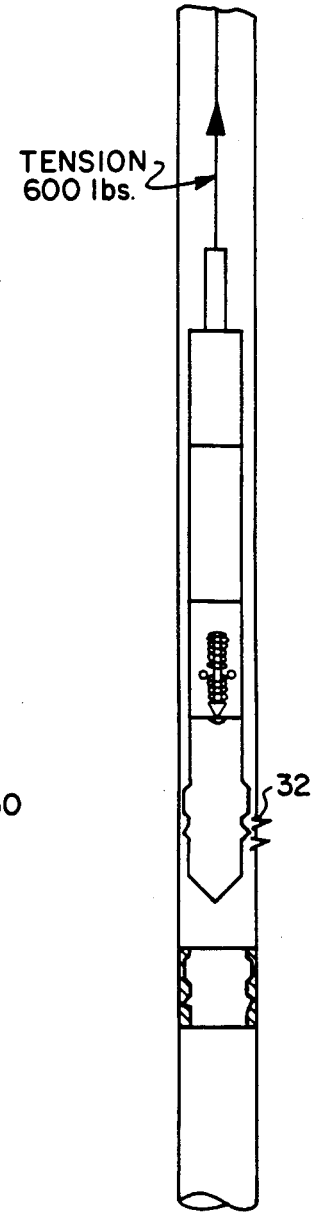
Figure 5:
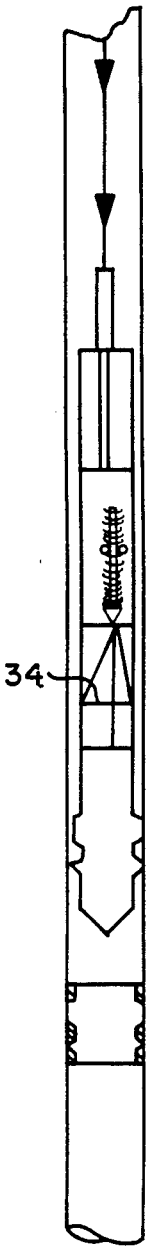
FIGS. 5–8 are schematic views similar to FIGS. 1–4, showing use of the tool for running, setting and releasing a bridge plug.
Figure 6:
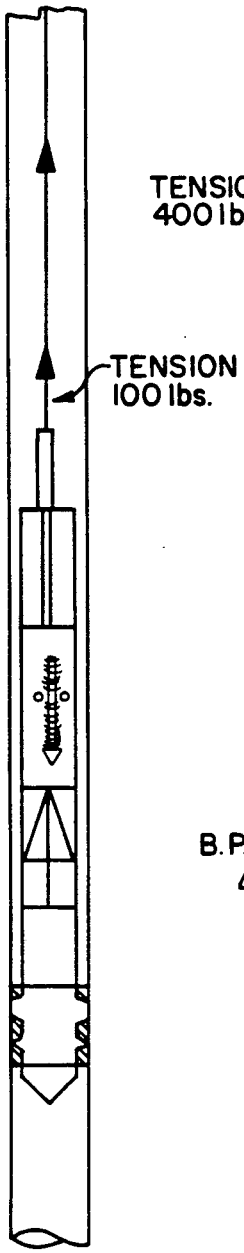
Figure 7:
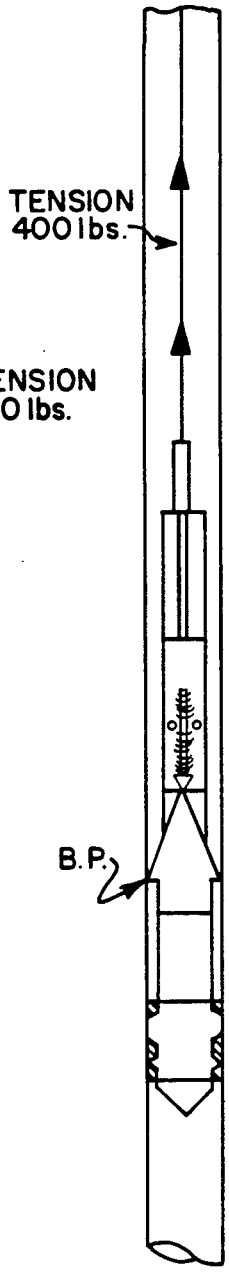
Figure 8:
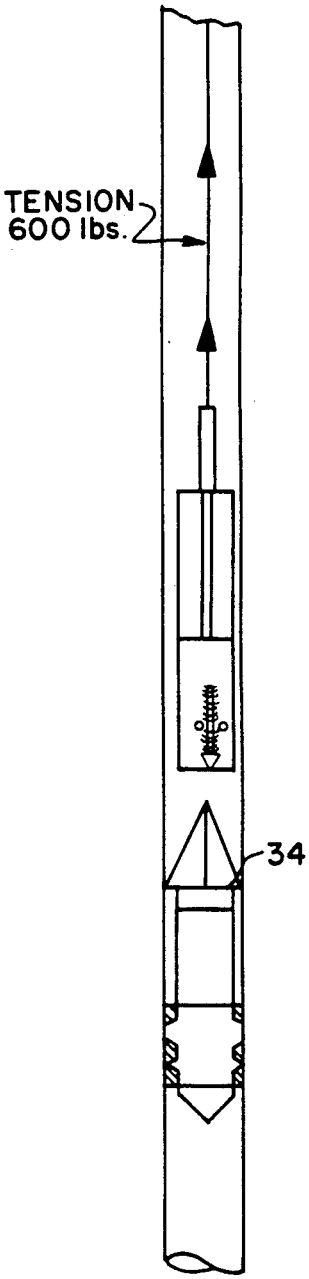
Figure 9:
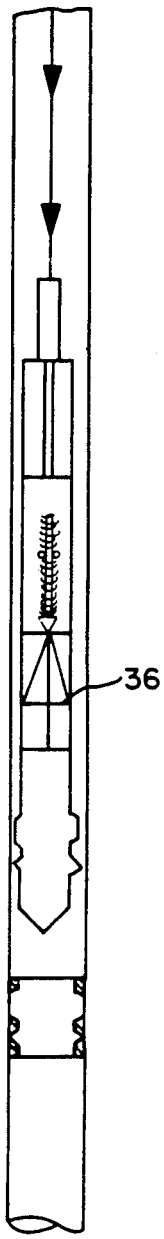
FIGS. 9–12 are schematic views similar to FIGS. 1–4, showing use of the tool for cutting the tubing.
Figure 10:
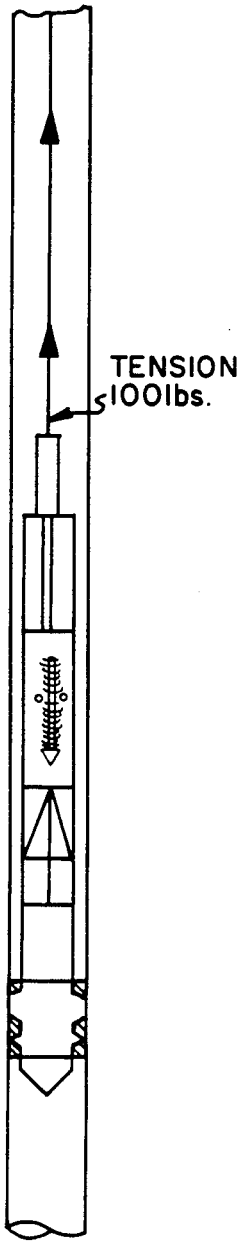
Figure 11:
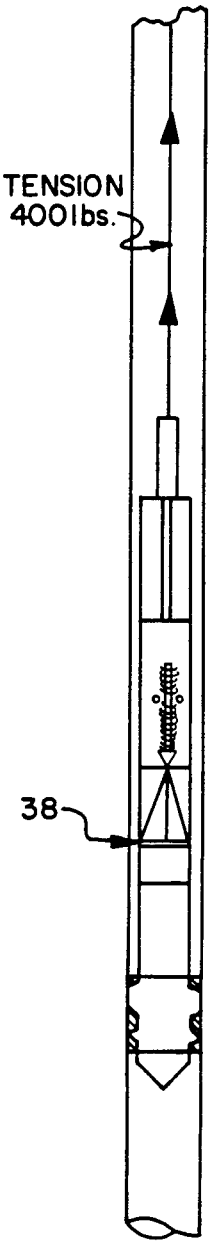
Figure 12:
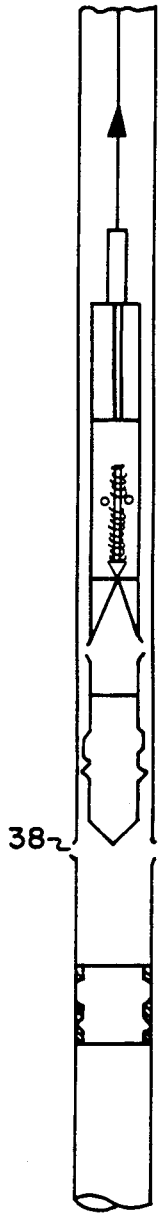

At the subsequent stage depicted in FIG. 4, as a result of a further, higher level of tension pulled upwards on the wireline 18 from above (e.g., 600 pounds of pull), the locking mandrel has come loose from the landing nipple, allowing the tool 16 to be bodily recovered from the hole on the wireline.

FIGS. 5–8 show a sequence of stages comparable to that which has just been described in relation to FIGS. 1–4, the sole exception being that in the tool 16, the perforating gun has been replaced by a bridge plug 34. The tool is shown being run in FIG. 5, locked and test-tensioned in FIG. 6, further tensioned to fire the firing head to set the bridge plug 34 in FIG. 7, and being separated by further tensioning and the portion above the bridge plug recovered on the wireline 18 in FIG. 8. A suitable bridge plug is commercially available, it is the Haliburton Logging Service "Magna Range" bridge plug.

FIGS. 9–12 show a sequence of stages comparable to that which has just been described in relation to FIGS. 1–4, the sole exception being that in the tool 16, the perforating gun has been replaced by a jet cutter 36. The tool is shown being run in FIG. 9, locked and test-tensioned in FIG. 10, further tensioned to actuate the jet cutter in FIG. 11, and recovered on the wire line 18 in FIG. 12, after the jet cutter has severed the tubing at 38. A suitable jet cutter is commercially available, it is the Jet Research or GO "X" jet cutter.

Figure 13:
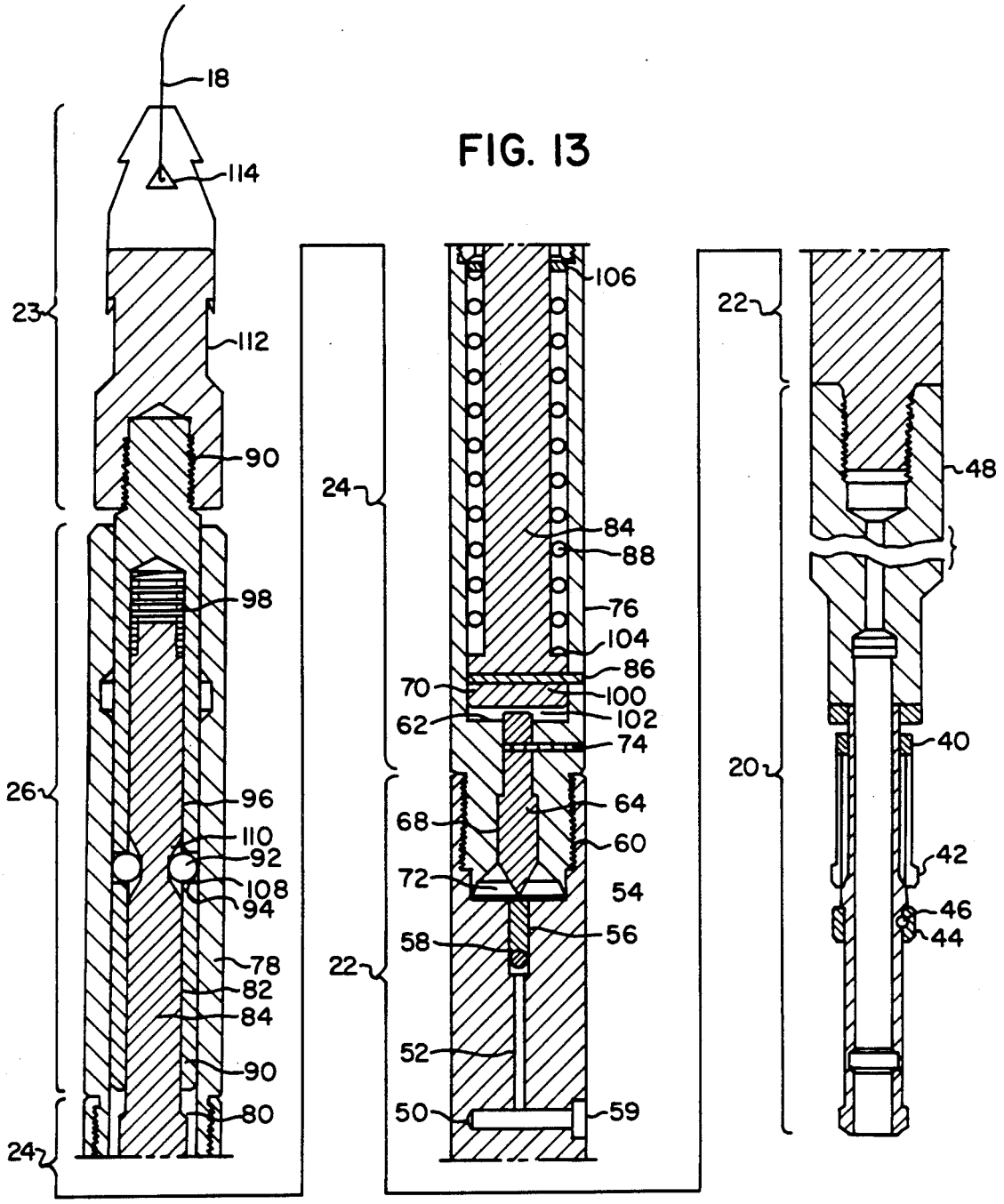
FIGS. 13–15 are somewhat larger scale longitudinal sectional views of a preferred embodiment of the tool, equipped for perforating a tubing, respectively showing the tool in initial assembly (running), cocked and firing positions thereof.
Figure 14:
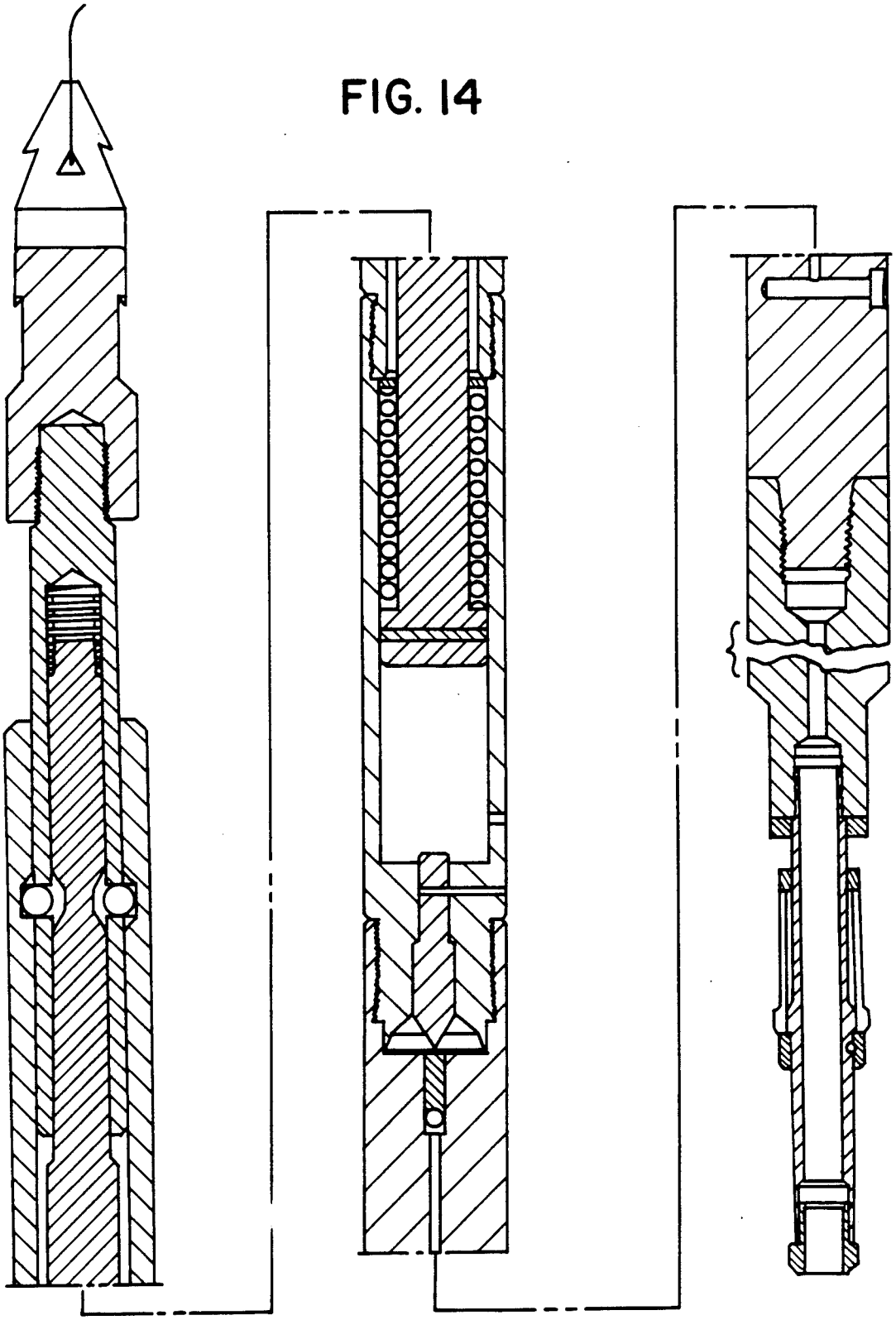
Figure 15:
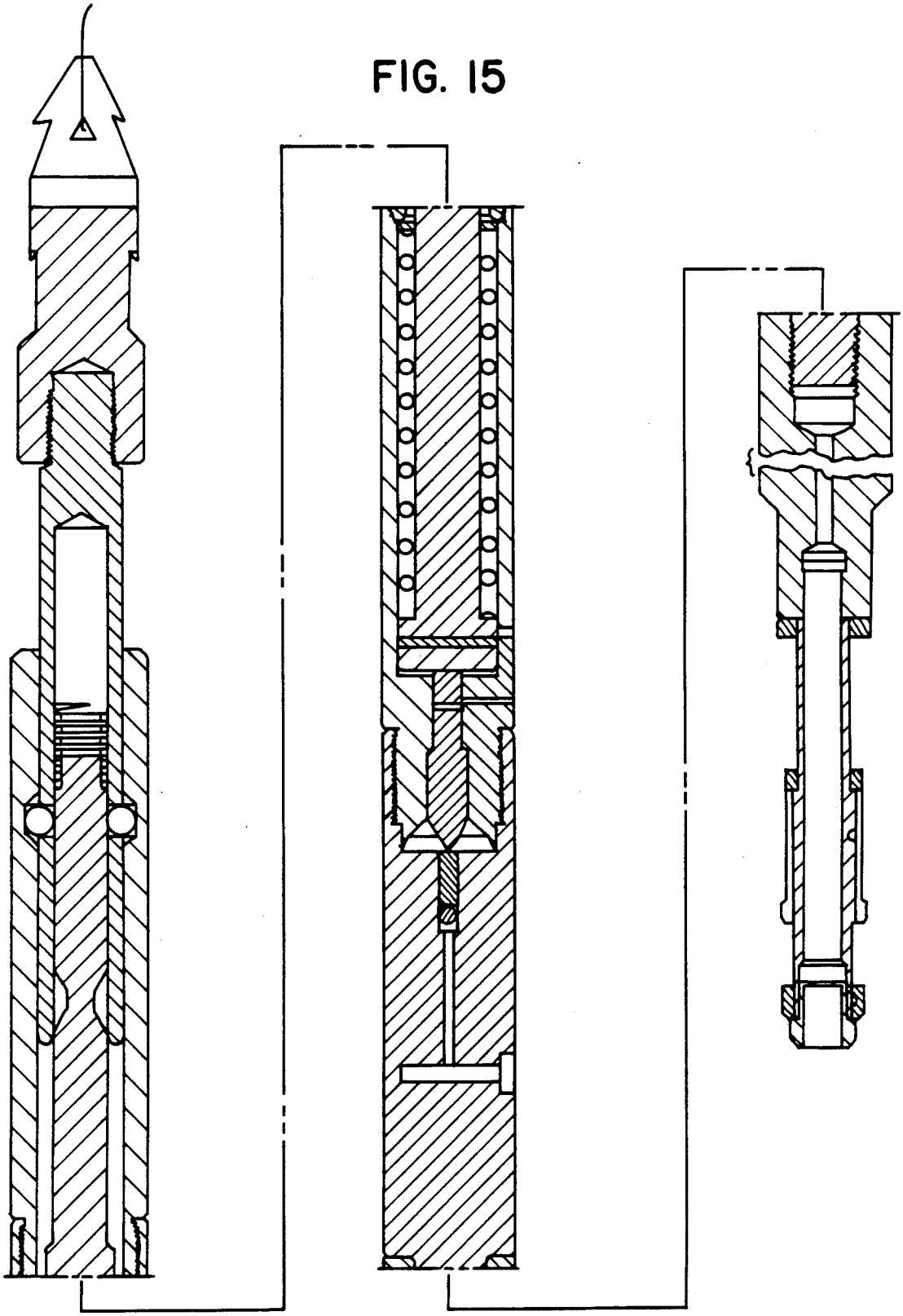

FIGS. 13–15 show in more detail a preferred embodiment of the tool 16 of FIGS. 1–4.

In FIG. 13, again starting from the bottom, a conventional locking mandrel is shown at 20. Particularly notice that its collet 40 has its dogs 42 relatively withdrawn in order to permit running, and that its stop collar 44 is held in place by a shear pin 46. The upper end of the locking mandrel 20 is shown threaded into the lower end of a sucker rod 48 (of any desired length, or absent), which is, in effect, a spacer for longitudinally spacing the perforating gun a desired distance above the seat 14 (of FIGS. 1–4). The upper end of the sucker rod 48 (or, if no such spacer is used, the upper end of the locking mandrel 20) is threaded into the lower end of the perforating gun 22 (which, in the instance depicted, is a single shot circulation gun). As shown, the perforating gun 22 has a laterally opening bore 50, blind at its opposite end, which, in use, receives a conventional explosive charge and/or jet shot 59. An axial bore 52 opens into an interiorly threaded box 54 at the upper end of the gun body 22, and intersects the lateral bore 50. A well 56 at the upper end of the axial bore 52, in use, receives a conventional percussively initiated cap or initiator 58. The floor of the box 54 supports a membrane or disk, e.g., made of brass, i.e., a piercing plate 72 typically 1.25 inches in diameter and 0.0312 inch thick.

The tool 16 further includes a trigger spring and firing pin housing 76 for the firing head 24, which is shown having a lower, pin end 60 threaded into the box 54. The firing head housing 74 has an internal longitudinal bore 70 which has an upwardly facing annular seat 62 provided at an abrupt reduction in internal diameter near its lower, pin end 60.

A firing pin 64, pointed downwards at 58 and axially slidably poised for rapid downward movement, is shown parked in the narrow, lower portion 68 of the bore 70, and pinned with its tip poised over the plate 72, in axial alignment with the well 56, by a shear pin 74.

The wireline jar 26 includes a tubular releasing sleeve 78 having a lower, pin end threaded into an upper box end of the housing 76, so that the longitudinal bore 80 of the sleeve 78 forms an axial continuation of the larger diameter portion of the bore 70 of the housing 76.

It should now be noticed that, near its upper end, the bore 80 is provided with a radially inwardly opening circumferential recess (which, in use, will receive locking balls; see FIGS. 14 and 15).

The axially elongated chamber 82 defined by the bore 80 and the enlarged portion of the bore 70 is shown receiving a mechanical jar assembly which includes a releasing and firing mandrel 84, a shear pin 86, a compression coil trigger spring 88, a releasing sleeve 90 telescoped onto the upper end portion of the mandrel 84, a set of locking balls 92, and (acting axially in compression between the upper end wall 94 of the longitudinal bore 96 in the releasing sleeve 90 and an upwardly facing annular shoulder formed on the mandrel 84 near the upper end of the latter) is provided a coil spring 98. (Typically, the spring 98 is a 40#/inch, Century S-1036 spring having a free length of 2.125 inches and a solid height of 1.104 inch; and the spring 88 is a 143#/inch Century 3145 spring having a free length of 5.062 inches and a solid height of 1.770 inch.

At the stage depicted in FIG. 13, the shear pin 86 maintains the lower, hammer end 100 of the mandrel 84 spaced axially above the upper end 102 of the firing pin 64, which protrudes above the shoulder 62 by an amount which is substantially greater than the thickness of the brass plate 72. The lower end of the spring 88 stands on a foot 104 provided on the hammer 100, so that the spring 88 surrounds about the lower half of the mandrel 84. The upper end of the spring 88 axially abuts a washer-like retaining ring 106 which, in turn, abuts the pin end of the releasing housing.

The locking balls 92, radially confined by the bore of the releasing housing, are radially cooperatively received in respective radial openings 108 provided in the releasing sleeve and a radially outwardly opening circumferential groove 110 in the upper portion of the mandrel 84, thereby locking the mandrel 84 and releasing sleeve 90 together for ganged axial movement.

The rope socket 23 is shown including a top latching head 112 that is threaded onto the upper protruding end of the releasing sleeve 90. The rope socket 23 further includes the structure 114, for connecting the top latching head 112 with the wireline 18.

In use, the tool 16, made up as has been described above in relation to FIG. 13, is run into a casing in a bore hole as has been described above in relation to FIG. 1. Upon reaching a predetermined level, its locking mandrel 20 seats on a seat 14 (FIG. 2), and its locking mandrel is conventionally actuated (FIG. 14) which forces its collet's locking dogs out into the seat 14 (FIG. 2).

As the wireline 18 is upwardly tensioned (FIG. 3), the shear pin holding the hammer to the sidewall of the trigger spring and firing pin housing shears, allowing the releasing and firing mandrel to move upwards in its chamber This compresses the firing spring and moves the locking balls towards radial adjacency with the circumferential pocket in the bore of the releasing housing. Upon reaching the level of the pocket, the locking balls move outwards so that they become cooperatively received in the pocket and the radial openings in the releasing sleeve. The action suddenly ungangs the releasing sleeve from the releasing and firing mandrel 84. Now, the firing spring quickly accelerates the releasing and firing mandrel downwards (compare FIGS. 14 and 15), causing the hammer to strike the firing pin, thereby driving the firing pin through the plate, setting off the initiator and exploding the charge that drives the jet shot out the lateral bore in the perforating gun, thereby perforating the casing (FIGS. 15 and 3).

Further upward tensioning of the wireline causes the shear pin on the stop collar of the locking mandrel 20 to shear, so that the locking collar drops, permitting the collet to slide down and resiliently collapse, removing its dogs from the seat 14, so that the tool 16 is free to be recovered on the wireline from downhole (FIGS. 15 and 4).

In general, in comparison with FIGS. 1–4 and 13–15, the structure that differs in FIGS. 5–8 and 9–12 is the perforating gun 22, which is simply replaced by a bridge plug assembly or a tubing cutter assembly.

It should now be apparent that the tension-actuated mechanical detonating device useful for detonating downhole explosive as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for performing an explosively initiate-operation downhole in a bore, comprising:

making up on a slick line a tool to include a latching device, an explosively initiated operator, a mechanically actuatable initiator for the explosively initiated operator, and a tension-cocked, spring-fired hammer;

lowering the tool into the bore until the latching device latches at a predetermined level;

thereafter, pulling an upward tension on the slick line to successively cock the hammer, compressing its spring, and releasing the hammer so that the spring accelerates the hammer against the initiator, thereby causing explosive initiation of the operator to provide the explosively initiated operation.

2. The method of claim 1, wherein:

the operator is a tubing wall perforator.

3. The method of claim 1, wherein:

the operator is a bridge plug.

4. The method of claim 1, wherein:

the operator is a tubing wall cutter.

5. The method of claim 1, further comprising:

a subsequent step of further tensioning the slick line and thereby unlatching the latching device and recovering the tool bodily from the bore on the slick line.

6. Apparatus for performing an explosively initiated operation downhole in a bore, comprising:

a slick line;

a tool including a latching device, an explosively initiated operator, a mechanically actuable initiator for the explosively initiated operator, and a tension-cocked, spring-fired hammer arranged to strike and thereby mechanically actuate the mechanically actuable initiator;

the tool being suspended from the slick line, for lowering in a bore to a predetermined level at which said latching device can anchor the tool, whereby pulling an upward tension on the slick line successively cocks the hammer and thereby causes the hammer to compress a firing spring and releases the hammer for downward acceleration by the firing spring against the initiator for causing explosive initiation of the operator to provide explosively initiated operation of the explosively initiated operator

7. The apparatus of claim 6, wherein:

said operator is a tubing wall perforator.

8. The apparatus of claim 6, wherein:

said operator is a bridge plug.

9. The apparatus of claim 6, wherein:

said operator is a tubing wall cutter.

* * * * *